United States Patent [19]

Amighini

[11] Patent Number: 4,492,106

[45] Date of Patent: Jan. 8, 1985

[54] MANUALLY ACTUATED HYDRAULIC JACK FOR COMPRESSIVELY APPLYING TERMINALS ON ELECTRIC CABLES AND CONDUCTORS IN GENERAL

[76] Inventor: Mario Amighini, Via Zadei 52, Brescia, Italy

[21] Appl. No.: 453,188

[22] Filed: Dec. 27, 1982

[30] Foreign Application Priority Data

Jan. 7, 1982 [IT] Italy ..... 19015 A/82

[51] Int. Cl.[3] ..... B21J 9/18

[52] U.S. Cl. ..... 72/453.02; 72/453.16; 72/410; 81/301; 29/751; 60/477

[58] Field of Search ..... 72/453.01, 453.02, 453.03, 72/453.15, 453.16, 409, 410, 416; 81/301; 417/535, 537; 60/477; 29/751

[56] References Cited

U.S. PATENT DOCUMENTS 2,688,231 9/1954 Northcutt ..... 81/301
2,845,033 7/1958 Wright ..... 417/535
3,674,381 7/1972 Schiff ..... 417/537
4,132,107 1/1979 Suganuma et al. ..... 72/453.16

*Primary Examiner*—Daniel C. Crane
*Assistant Examiner*—David B. Jones
*Attorney, Agent, or Firm*—Guido Modiano; Albert Josif

[57] ABSTRACT

The jack comprises a fixed jaw, rigidly associated with the jack body, and a movable jaw facing said fixed jaw and being connected to a piston sealingly movable inside a cylindrical chamber. In the body, first and second chambers are provided, respectively in communication, through a first delivery conduit and first intake conduit, and through a second delivery conduit and second intake conduit, with the cylindrical chamber and a working fluid reservoir, in the first chamber there being sealingly movable a high pressure piston, whereto is connected a lug passed through the second chamber in sealed relationship therewith, wherein it acts by contact on an elastically biased low pressure piston, the high pressure piston being connected at the free end thereof to an actuating lever handle.

4 Claims, 3 Drawing Figures

MANUALLY ACTUATED HYDRAULIC JACK FOR COMPRESSIVELY APPLYING TERMINALS ON ELECTRIC CABLES AND CONDUCTORS IN GENERAL

BACKGROUND OF THE INVENTION

This invention relates to a manually actuated hydraulic jack for compressively applying terminals onto electric conductors in general.

As is known, to clamp terminals onto electric conductors, hydraulically operated tools are used which are manually actuated and have a fixed jaw, associated with the tool body, and a moving jaw arranged opposite the fixed jaw for translation relatively to the fixed jaw by the action of a piston associated with the moving jaw.

The piston movement is accomplished by pumping with a lever handle pivoted to the tool body, which is moved to and from the tool body to produce a pumping effect.

With prior tools of the above type, only the handle forward stroke represents an active or working stroke contributing to the movement of the moving jaw, whereas the reverse stroke represents a passive stroke which can produce no movement of the jaw.

Thus, with such conventional arrangements, the time required to compress the terminal is relatively long, even if devices are provided which provide an initial fast forward stroke portion for the moving jaw toward the terminal and a final slow forward stroke portion for compression.

Furthermore, with such conventional tools the reverse or return stroke must be completed manually by the operator.

SUMMARY OF THE INVENTION

Accordingly the task of this invention is to remove the above-described drawbacks by providing a manually actuated hydraulic jack, wherein both strokes of the lever handle, i.e. both the forward and reverse strokes thereof, can be used to move the piston.

Within that task it is an object of the invention to provide a manually actuable hydraulic jack, wherein the reverse or opening stroke is in practice effected by the hydraulic jack automatically concurrently with the moving jaw forward movement.

Another object of this invention is to provide a hydraulic jack as indicated, which, by virtue of its peculiar construction, allows the fast forward stroke portion of the moving jaw to be completed automatically, followed by the slow forward stroke portion with compressive application of the terminal.

Yet another object of this invention is to provide a manually actuated hydraulic jack which can give full assurance of reliable and safe operation.

According to one aspect of the present invention the above task and objects, as well as yet other objects, such as will be apparent hereinafter, are achieved by a manually actuated hydraulic jack for compressively applying terminals on electric cables and conductors in general, comprising a fixed jaw rigidly assoicated with the hydraulic jack body and a moving jaw facing said fixed jaw and being connected to a piston sealingly movable within a cylindrical chamber, characterized in that it comprises, within said body, a first chamber and a second chamber, in communication, respectively through a first delivery conduit and first intake conduit, and through a second delivery conduit and second intake conduit, with said cylindrical chamber and a working fluid reservoir, in said first chamber there being sealingly movable a high pressure piston having a lug connected thereto and arranged to pass through said second chamber in sealed relationship, wherein said lug acts by contact on an elastically biassed low pressure piston, said high pressure piston being connected, at the free end thereof, to an actuating lever handle.

BRIEF DESCRIPTION OF THE DRAWINGS

Further features and advantages will be more clearly understood from the following description of a preferred, though not limitative, embodiment of this manually actuated hydraulic jack for compressively applying terminals on electric cables and conductors in general, with reference to the accompanying illustrative drawing, where.

DESCRIPTION OF THE PREFERRED EMBODIMENT

Figures 1, 2, 3:
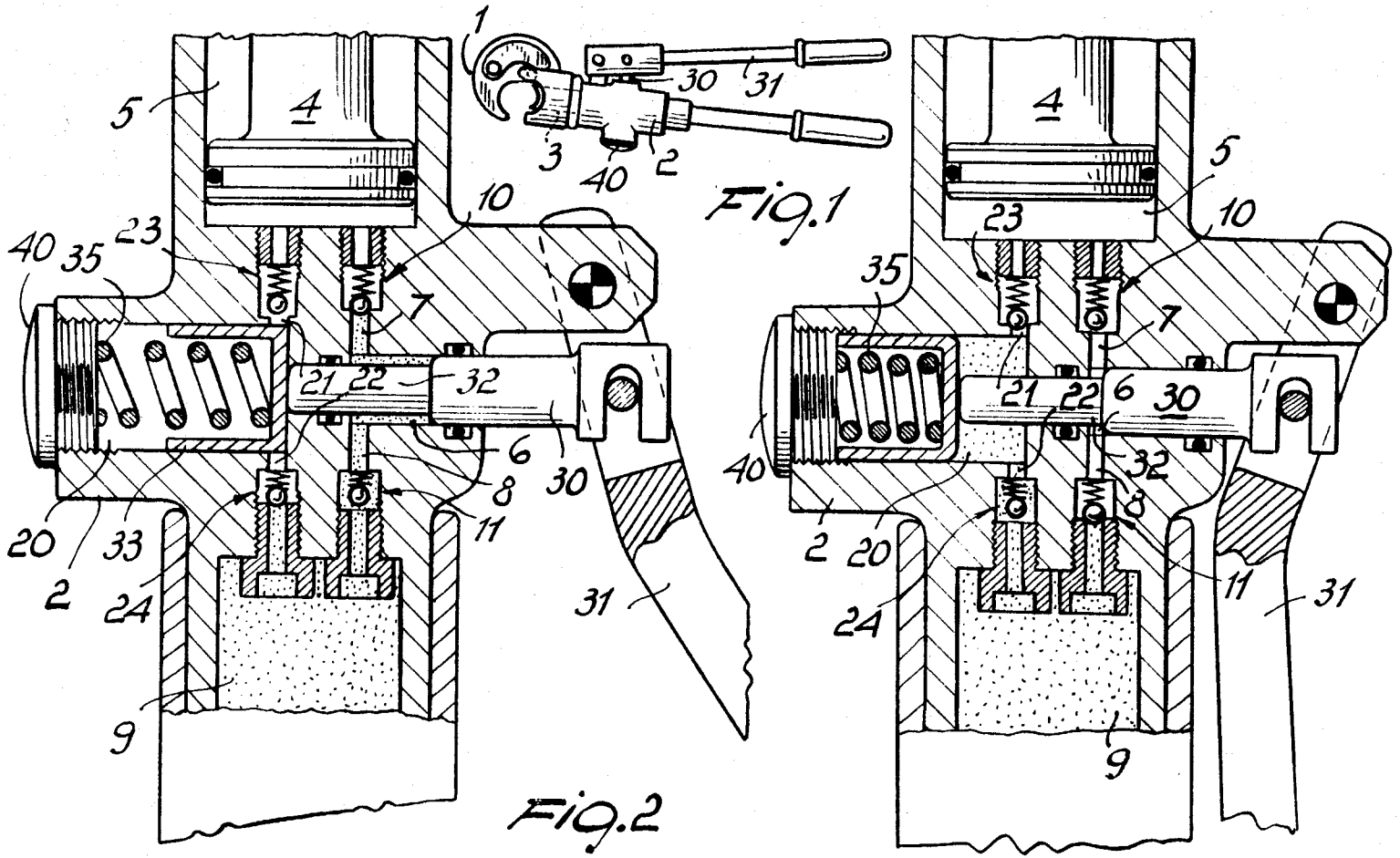
FIG. 1 shows schematically the manually actuated hydraulic jack of this invention.
FIG. 2 is a sectional detail view of the actuating portion, shown in a first operating position thereof.
FIG. 3 is a sectional detail view of the actuating portion, shown in a second operating position thereof.

Making reference to the cited drawing figures, the manually actuated hydraulic jack for compressively applying terminals on electric cables and conductors in general, according to the invention, comprises a fixed jaw 1 which is rigidly connected to the body 2 of the hydraulic jack according to this invention. Arranged to face said fixed jaw 1 is a moving jaw 3, which can be translated relatively to the fixed jaw 1 under the action of a piston 4 which is sealingly movable inside a cylindrical chamber 5, defined on the interior of the body 2.

Defined inside the body 2 is a first chamber 6, which is in communication, through a first delivery conduit 7, with said cylindrical chamber 5, and through a first intake conduit 8 with a working fluid reservoir 9 which is defined on the interior of the body 2 or of the handle of the hydraulic jack of this invention.

Arranged to operate on the first delivery conduit 7 is a first one-way valving means 10 which only admits the flow of working fluid from the first chamber 6 to the cylindrical chamber 5 while, on the first intake conduit 8, there acts a second one-way valving 11 which only admits the working fluid flow from the reservoir 9 to the first chamber 6.

In axial alignment with the first chamber 6, there is formed a second chamber 20, which communicates to the cylindrical chamber 5 through a second delivery conduit 21 and to the reservoir 9 through a second intake conduit 22.

Active on the delivery conduit 21 is a third one-way valving means 23, which only admits the working fluid flow from said second chamber to said cylindrical chamber 5, while, arranged to operate in said second intake conduit 22, is a fourth one-way valving means 24 which only admits the working fluid flow from said reservoir 9 into said second chamber 20.

Sealingly movable within said first chamber 6 is a high pressure piston 30, which is pivoted, as its outboard free end, with an actuating lever 31 articulated on the body 2, which performs the function of translating the high pressure piston 30 in the axial direction.

From the high pressure piston 30, there extends axially a lug 32 which is passed through the second chamber 20 in sealed relationship.

Within said second chamber 20, the lug 32 acts by contact on the head of a low pressure piston sealingly movable in said chamber 20 and comprising a cap element 33. The cap element 33 of bowl-like shape, defines a base and a seat therein, wherein said base has an outer face cooperating with the lug 32 and an inner face in contact with an elastic means at last partially recieved in the seat formed in the element 33. The elastic means comprises a coil spring 35, which holds the cap element 33, forming the low pressure piston, elastically pressed against the end of the lug 32.

The chamber 20 is closed, at the end thereof against which the spring 35 acts, by a threaded plug 40 which enables calibration of the spring 35, to vary its elastic bias force.

The manually actuated hydraulic jack according to the invention operates as follows. As the actuating lever handle 31 is moved toward the body 2, the lug 32, in compressing the spring 35 causes the cap element 33 to move to the left, as viewed in the drawing, with consequent drawing of working fluid from the reservoir 9 toward the chamber 20; simultaneously therewith, during the forward stroke of the lever handle 31 or movement thereof toward the body 2, the high pressure piston 30 will pump the working fluid present in the chamber 6 into the cylindrical chamber 5.

Upon completion of the forward stroke, the lever handle 31 is elastically moved away from the body 2 by the action of the spring 35, and moreover, during this same stage, the cap element 33, forming the low pressure piston, will transfer the working fluid present in the second chamber 20 into the chamber 5, while the high pressure piston 30 is drawing working fluid from the reservoir 9.

As the swinging movement of the actuating lever handle 31 about its pivot is continued, working fluid is pumped into the cylindrical chamber 5, both during the forward stroke and reverse or return stroke.

In particular, during the reverse or return stroke, a large amount of working fluid is admitted into the chamber 5 to perform, in practice, the fast forward stroke portion of the moving jaw 3 movement toward the fixed jaw 1.

As the pressure level of the fluid in the chamber 5 equals the pressure force applied on the low pressure piston 33 by the spring 35, the low pressure piston is held stationary, thereby further admission of working fluid is only effected by the high pressure piston 30, which is enabled to introduce smaller amounts of fluid under a high pressure into the chamber 5, thus producing the compressive final forward stroke portion of the moving jaw 3 onto the terminal.

The compressive action is maintained until a desired compression of the terminal is achieved.

In actual practice, it occurs that the fast forward stroke portion completed as the actuating lever 31 is moved away by the bias force of the spring 35 continues until the low pressure piston is virtually self-suppressed, in that the force it can exert is counterbalanced by the pressure prevailing in the chamber 5, so that the operation can only be continued through the action of the high pressure piston 30.

It will be appreciated from the foregoing that the invention achieves its objects. In particular, the manually actuated hydraulic jack according to this invention enables application of a pumping action on the working fluid both during the forward stroke of the lever handle and during the return stroke of the actuating lever 31, or movement thereof away from the body 2, which movement away from the body 2 is provided by the action of the spring 35 automatically.

Thus, this embodiment affords the effectuation of a fast forward stroke portion by the moving jaw 3, since the working or useful cross-section of the low pressure piston 33 is greater than the working or useful cross-section of the high pressure piston 30.

The invention basic concept is susceptible to many modifications and variations without departing from its scope.

Furthermore, all of the details may be altered as desired to meet contingent application requirements.

In practicing the invention, the materials used, and the dimensions and contingent shapes, may be any suitable ones.

I claim:

1. A manually actuated hydraulic jack for compressively applying terminals on electric cables and conductors in general, comprising a jack body, a fixed jaw rigidly associated with said jack body, a moving jaw facing said fixed jaw, an actuating lever handle pivoted to said jack body for effecting a forward stroke toward said jack body and a reverse return stroke, a cylindrical chamber in said body, a piston movable within said cylindrical chamber and rigidly connected to said movable jaw, a working fluid reservoir, first and second chambers in said jack body, a first intake conduit and a first delivery conduit for establishing communication between said reservoir and said first chamber and between said first chamber and said cylindrical chamber, second intake conduit and second delivery conduit for establishing communication between said reservoir and said second chamber and between said second chamber and said cylindrical chamber, one-way valving means in said intake and said delivery conduits for controlling said intake and said delivery conduits, a high-pressure piston sealingly movable in said first chamber and pivoted to said actuating handle, a low-pressure piston movable in said second chamber, elastic bias means in said second chamber acting on said low-pressure piston, said high-pressure piston having a lug protruding out of said first chamber toward said second chamber and acting on said low-pressure piston, for urging it, during the forward stroke of the actuating lever handle, to a retracted filling position where said elastic means is compressed wherein said second chamber is filled in use with working fluid through said second intake conduit and said first chamber has discharged working fluid contained therein through said first delivery conduit, said elastic means acting on said low-pressure piston during the reverse stroke of said actuating lever handle for bringing said low-pressure piston in its expanded position to discharge the working fluid filling said second chamber through said second delivery conduit and urge said high-pressure piston in its retracted position where said first chamber is filled with working fluid through said first intake conduit.

2. A manually actuated hydraulic jack according to claim 1, wherein said first and second chambers are positioned in mutual axial alignment relationship.

3. A manually actuated hydraulic jack according to claim 1, wherein said low-pressure piston comprises a cap element of bowl-like shape having a base and defining a seat therein, said base of said bowl-like cap element forming an outer face and an inner face, said lug of said high-pressure piston cooperating with said outer face of said cap element base for urging said low-pressure piston in its retracted position, and said elastic means being at least partially accomodated in said seat defined in said bowl-like cap element and acting on said inner face of said cap element base for urging said low-pressure piston in its expanded position during the reverse stroke of said actuating handle.

4. A manually actuated hydraulic jack for compressively applying terminals on electric cables and conductors in general, comprising a jack body, a fixed jaw rigidly associated with said jack body, a moving jack facing said fixed jack, an actuating lever handle pivoted to said jack body for effecting a forward stroke toward said jack body and a reverse return stroke, a cylindrical chamber in said body, a piston movable in said cylindrical chamber and rigidly connected to said movable jaw, a working fluid reservoir, first and second chambers axially aligned to each other in said jack body, a first intake conduit and a first delivery conduit for establishing communication between said reservoir and said first chamber and between said first chamber and said cylindrical chamber, a second intake conduit and a second delivery conduit for establishing communication between said reservoir and said second chamber and between said second chamber and said cylindrical chamber, one-way valving means in said intake and said delivery conduits for controlling said intake and said delivery conduits, a high-pressure piston sealingly movable in said first chamber and pivoted to said actuating lever handle, a low pressure piston movable in said second chamber, said low pressure piston comprising a cap element of bowl-like shape having a base and defining a seat therein, said cap element base forming an outer face and an inner face, elastic bias means in said second chamber at least partially received in said cap element seat and acting on said inner face of said cap element base, said high-pressure piston having a lug protruding out of said first chamber towards said second chamber and acting on said outer face of said cap-element base for urging said low-pressure piston, during the forward stroke of the actuating lever handle, to a retracted filling position where said elastic means is compressed, said second chamber is filled with working fluid through said second intake conduit and said first chamber has discharged working fluid contained therein through said first delivery conduit, said elastic means acting on said base outer face of the cap element during the reverse stroke of said actuating handle for bringing said low-pressure piston in its expanded position to discharge the working fluid filling said second chamber through said second delivery conduit and urge said high-pressure piston in its retracted position where said first chamber is filled with working fluid through said first intake conduit.

* * * * *